US009836916B2

(12) United States Patent
Koza et al.

(10) Patent No.: US 9,836,916 B2
(45) Date of Patent: Dec. 5, 2017

(54) PLAYER-CONTROLLED VOLATILITY IN GAMING EQUIPMENT

(71) Applicants: Steven Andrew Koza, Las Vegas, NV (US); Russell Brooke Dunn, Henderson, NV (US)

(72) Inventors: Steven Andrew Koza, Las Vegas, NV (US); Russell Brooke Dunn, Henderson, NV (US)

( * ) Notice: Subject to any disclaimer, the term of this patent is extended or adjusted under 35 U.S.C. 154(b) by 273 days.

(21) Appl. No.: 14/716,632

(22) Filed: May 19, 2015

(65) Prior Publication Data

US 2015/0339876 A1 Nov. 26, 2015

Related U.S. Application Data

(60) Provisional application No. 62/001,130, filed on May 21, 2014.

(51) Int. Cl.
*G07F 17/00* (2006.01)
*G07F 19/00* (2006.01)
*G07F 17/32* (2006.01)

(52) U.S. Cl.
CPC ..... *G07F 17/322* (2013.01); *G07F 17/3209* (2013.01); *G07F 17/3244* (2013.01); *G07F 17/3276* (2013.01)

(58) Field of Classification Search
CPC ..... G07F 17/322; G07F 17/3209; G07F 17/3276; G07F 17/3244
USPC ..... 273/292
See application file for complete search history.

(56) References Cited

U.S. PATENT DOCUMENTS 7,311,598 B2 * 12/2007 Kaminkow ..... G07F 17/32 463/16
8,753,201 B2 * 6/2014 Denlay ..... 273/149 R
8,821,239 B1 * 9/2014 Chun ..... A63F 1/067 463/11
2003/0119579 A1 * 6/2003 Walker ..... G07F 17/32 463/20
2006/0030386 A1 * 2/2006 Rosemberg ..... G07F 17/3293 463/13

(Continued)

OTHER PUBLICATIONS

Grochowski, John, Cents and Sensibility—An expanded slot world means there's that much more players need to know, http://www.casinocenter.com/cents-and-sensibility, 3 pages, printed Mar. 18, 2016.

(Continued)

*Primary Examiner* — Milap Shah
(74) *Attorney, Agent, or Firm* — Mark A. Litman & Associates, P.A.

(57) ABSTRACT

A method and apparatus for playing a wagering game on a gaming apparatus enables different paytables and related volatility wagers on at least one of an underlying wagering game and a side bet wager against a paytable. The method allows a player placing a wager on the underlying wagering game; and the player placing a wager on the side bet. The method further allows providing a physical random event outcome in the underlying wagering game on which both the underlying game and the side bet are based. At least one of the wager on the underlying wagering game and the wager on the side bet is made on at least one of two available wagers having differing volatilities from each other.

20 Claims, 8 Drawing Sheets

(56) References Cited

U.S. PATENT DOCUMENTS

2007/0060252 A1* 3/2007 Taylor ..... G07F 17/3262 463/16
2008/0076503 A1* 3/2008 Mattice ..... G07F 17/3244 463/16
2008/0076506 A1* 3/2008 Nguyen ..... G07F 17/3218 463/16
2008/0113767 A1* 5/2008 Nguyen ..... G07F 17/32 463/25
2008/0113811 A1* 5/2008 Linard ..... G07F 17/32 463/42
2008/0261682 A1* 10/2008 Phillips ..... G07F 17/322 463/25
2008/0274783 A1* 11/2008 Walker ..... G07F 17/32 463/13
2010/0004047 A1* 1/2010 Acres ..... G07F 17/3244 463/20
2010/0041461 A1* 2/2010 Demsetz ..... G07F 17/3262 463/20
2010/0171267 A1* 7/2010 Walker ..... G07F 1/06 273/274
2013/0274012 A1* 10/2013 Aoki ..... G07F 17/323 463/31
2016/0071356 A1* 3/2016 Rehill ..... A63F 13/80 463/13

OTHER PUBLICATIONS

A Screen Short of Incredible Technologies, Inc., 2010 "Cars" video gaming title, with an explanation of the Magic Screen(TM) function.

New Slots from Golden Tee Maker Wow G2E Attendees, https://gaming.itsgames.com/company/news/new-slots-from-golden-tee-maker-wow-g2e-attendees , Incredible Technologies, Inc., Posted on Nov. 25, 2008, Printed on Mar. 19, 2016.

Incredible Technologies' Magic Touch slot machine debuts at Barona, May 6, 2010, www.itcasinogames.com , 2 pages.

* cited by examiner

PLAYER-CONTROLLED VOLATILITY IN GAMING EQUIPMENT

RELATED APPLICATION DATA

This application claims priority from Provisional U.S. Patent Application Ser. No. 62/001,130, filed 21 May 2015.

BACKGROUND OF THE INVENTION

1. Field of the Invention

The present invention relates to the field of table games and especially to table games with electronic components enabling wager resolutions within the gaming table.

2. Background of the Art

Gaming technology has advanced significantly over the years, and especially within the past two decades since the introduction and allowance of intelligent systems into the field. The use of processors, video displays, electronic accounting, and general processor control over gaming systems has provided much greater breadth in the types and controls of games used within the gaming industry.

The biggest impact that artificial intelligence and processor technology has had on the gaming industry has been in the video gaming segment of the industry and with respect to the potential for on-line gaming.

The use of video displays and processors in the design of slot type gaming apparatus (generally referred to as slot machines or video machines) has provided significant types of entertainment value and game play and images not previously available on the predominantly mechanical systems. Virtual images provide better artistic input into designs, and the processor technology allows for complex wagers and complex paylines to be resolved quickly and accurately.

The electronic technology has been less significant within the table game segment of the gaming industry. The technology has provided for some cardless gaming tables (virtual playing cards are randomly provided by a processor), electronic wagering (with physical cards, bonus wagers and/or virtual playing cards) and some available signage on the table. Roulette and dice wagering has also been implemented, which also allows for easier resolution of complex wagering.

In analyzing the underlying mathematics of gambling games, several statistical parameters are used. In particular, every wager made has a house advantage, which is the average percentage of such wager that the house expects to win on each play of the game. So, for a game with a two percent house advantage, the house expects, in the long run, to win an average of two cents for every dollar wagered. Of course, this is an average over a large number of plays. In the short term, the actual results for the player will vary to some degree from this average. The degree to which the short-term results vary from the long-term average expected house win is referred to as the volatility index, or more succinctly, the volatility of the game.

The volatility of any game of chance is calculated as the standard deviation for one round, betting one unit. Generally, the greater the short-term swings of wins and losses, the greater the volatility. Another way to view this is that games with a large number of small wins have lower volatility than games with a smaller number of large wins.

One feature that has been suggested for implementation on electronic video gaming apparatus includes an ability of players to alter paytables in such a way that they alter the volatility in the games being played. Such proposed technology exclusively for video gaming equipment is described in the following exemplary references.

U.S. Published Patent Application Document No. 20080081688 (Plowman) describes a gaming machine that provides a wagering game, including a user interface in communication with a game controller, through the operation of which a player selects one of a plurality of wager options that determine a number of symbols to be active and inactive in the wagering game. For at least one said wager option at least one, but not all of the plurality of symbols that define a possible said winning combination are rendered inactive for forming the winning combination. The gaming machine includes a console having a display on which is displayed representations of a game that can be played by a player.

U.S. Published Patent Application Document No. 20070060252 (Taylor) describes a gaming device in which a player may select from several mathematical bias settings of volatility. Each setting results in different volatility, the mathematical parameter of statistical dispersion of results between fewer numbers of lower rewards and larger numbers of greater rewards. The player may receive indicia of the settings of volatility and may alter volatility settings during various stages of play. The player may alter reel strips in order to accomplish volatility changes or other methods of change of the volatility of the game may be provided.

U.S. Published Patent Application Document No. 20050282610 (Palmer) describes a processor controlled gaming device having a display device in communication with the processor. When the display device receives an input from the player, gaming device randomly generates an outcome, the display device displays an event having the outcome and the gaming device provides the player with a payout in association with the outcome and the selected input. The inputs have paytables that vary in range. One input has a large, risky payout range with big and small payouts. One input has a small, conservative payout range with intermediate payouts. Other inputs have ranges that fall in between the risky and conservative ranges. Each of the ranges has the same overall expected value, so that the gaming device does not favor the player's choice of a risky or conservative input.

U.S. Published Patent Application Document No. 20150087377 (Yee) discloses methods of administering games of roulette may involve accepting a wager may from a player on numerous different structural platforms. A multiplier may be randomly selected from a group of fixed multipliers for a payout on the wager. A number and associated color may be randomly generated from within a range of numbers and associated colors. The wager may be resolved by determining whether the randomly generated number is identical to a randomly generated number from an immediately preceding round. A payout may be paid to the player when the randomly generated number is identical to the randomly generated number from the immediately preceding round, an amount of the payout being equal to an amount of the wager multiplied by the randomly selected multiplier. The amount of the wager may be collected for the house when the randomly generated number is different from the randomly generated number from the immediately preceding round.

Electronic gaming tables or intelligent gaming tables are known in the gaming art for simulated play of table games, including playing card games. These systems may be entirely electronic, without any physical game elements except for the electronic apparatus itself, or may blend in physical gaming components in a hybrid system where dice are tossed or read (in a confined enclosure or on a gaming table), a roulette ball is dropped into a spinning wheel (in a read or enclosed system) or where physical playing cards are randomly provided to players with electronic reading and identification of cards and ranks or counts at individual player positions. Examples of these systems are found in U.S. Pat. Nos. 8,529,345 (Nguyen); 8,506,376 (Kuhn); 8,376,362 (Nicely); 8,348,747 (Arezina); 8,333,6752 (Nguyen); 8,287,380 (Nguyen); 8,277,314 (Wolf); 8,272,958 (Smith); 8,272,945 (Kelly); 8,262,475 (Snow); 8,147,316 (Arezin); 8,142,271 (Kuhn); 8,087,903 (Longway); 7,661,676 (Smith); 7,309,065 (Yoseloff); and a series of patents to Soltys (U.S. Pat. Nos. 6,517,435; 6,517,436; 6,519,283; 6,520,857; 6,527,271; 6,530,836; 6,530,837; 6,532,297; 6,533,276; 6,533,661 among other). All cited references are incorporated herein in their entirety.

SUMMARY OF THE INVENTION

A method of controlling volatility in gaming environments is enabled on an intelligent gaming table having multiple player positions and individual player input positions having:

a) a gaming table surface;

b) individual player input positions on the table, each player input position comprising an individual player display screen area and individual player input controls;

c) a game processor executing code to perform a wagering game at the electronic gaming table;

d) a random event generator that provides a random event outcome for the wagering game and which provides information used by the processor to determine wagering game outcomes at each individual player input position where a wager has been placed in the wagering game;

e) each individual player input position having a control that provides information to the processor of an individual player position selection of one of a multiple number of available paytables and related volatility levels on which player position wagers at that individual player input position are made for a single wagering game; and f) the processor configured to resolve player position wagers at each individual player input position based upon the selected paytable and volatility level for each individual player input position based on a single random event outcome for the wagering game.

DETAILED DESCRIPTION OF THE INVENTION

Figure 1:
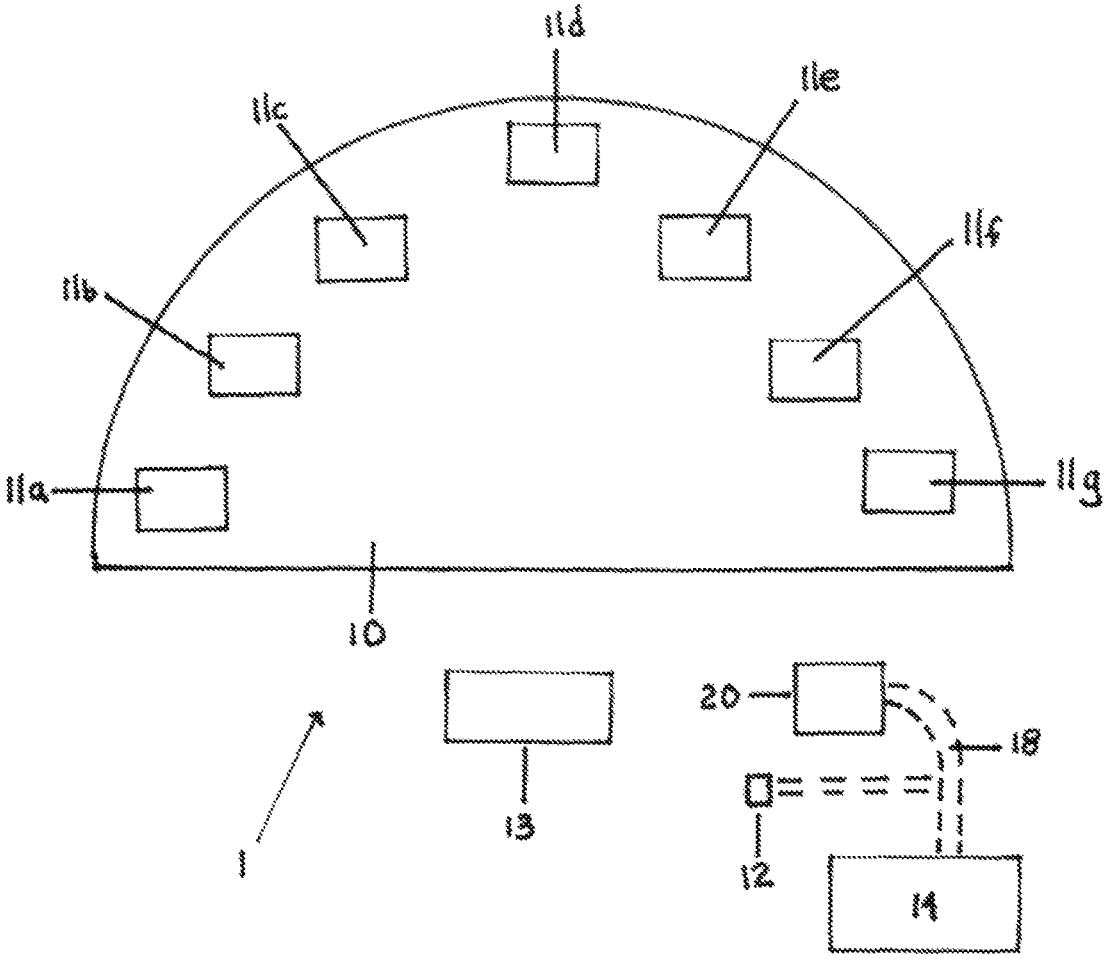
FIG. 1 (PRIOR ART)
FIG. 1 shows a schematic of certain embodiments that function in conjunction with a player monitoring system.

A method of controlling volatility in gaming environments is enabled on an intelligent gaming table having multiple player positions and individual player input positions having:

a) a gaming table surface.

The gaming table surface may be part of a wholly electronic gaming table or mixed electronic and physical gaming elements. In a wholly electronic gaming table, random events are provided via an electronic random number generator in a processor system where random outcomes are virtually simulated with visible displays of the events provided. For example, a random number generator provides naturally or artificially weighted outcomes for any of reels in a slot game, playing cards in a poker game or video poker game, a pair of dice in electronic craps, or provides naturally weighted outcomes for a candy wheel or roulette, and a visual display screen displays images of the randomly determined outcomes. The processor determines payouts for the results, and the payouts are based on selected paytables and related volatility rates for the game played.

b) individual player input positions on the table, each player input position comprising an individual player display screen area and individual player input controls.

Electronic gaming terminals that are part of roulette tables, craps tables and card tables are well known in the art. Either a touch screen paytable and related volatility slide or a physical variable resistor or rheostat alters or controls the paytable according to the practices of the present technology. The touchscreen is merely an additional pressure sensitive control zone on a screen, and the switch/slide may be in the frame of the display or a separate component or element on the table.

c) a game processor executing code to perform a wagering game at the electronic gaming table.

Any wagering game can be used, with the paytables and related volatility levels designed into the software design of the games. The style, content and nature of paytable adjustments is explained in greater detail herein.

d) a random event generator that provides a random event outcome for the wagering game and which provides information used by the processor to determine wagering game outcomes at each individual player input position where a wager has been placed in the wagering game.

Random event generators, especially electronic random event generators as compared to physical random event generators (e.g., physical dice, physical playing cards, physical roulette wheels, physical candy wheels and the like) are well understood and generally enabled in the gaming arts.

e) each individual player input position having a control that provides information to the processor of an individual player position selection of one of a multiple number of available volatility levels on which player position wagers at that individual player input position are made for a single wagering game.

The controls may be any acceptable control such as, but not limited to touchscreens, buttons, toggles, slides, knobs, joysticks and combinations thereof.

f) the processor is configured to resolve player position wagers at each individual player input position based upon the selected volatility level for each individual player input position based on a single random event outcome for the wagering game.

For the purposes of illustration, a few differences between PC systems and gaming systems will be described. A first difference between intelligent gaming tables and common PC based computers systems is that some intelligent gaming tables may be designed to be state-based systems. In a state-based system, the system stores and maintains its current state in a non-volatile memory, such that, in the event of a power failure or other malfunction the intelligent gaming table will return to its current state when the power is restored. For instance, if a player was shown an award for a table game and, before the award could be provided to the player the power failed, the intelligent gaming table, upon the restoration of power, would return to the state where the award is indicated. As anyone who has used a PC, knows, PCs are not state machines and a majority of data is usually lost when a malfunction occurs. This requirement affects the software and hardware design on an intelligent gaming table.

A second important difference between intelligent gaming tables and common PC based computer systems is that for regulation purposes, various software which the intelligent gaming table uses to generate table game play activities (such as, for example, the electronic shuffling and dealing of cards) may be designed to be static and monolithic to prevent cheating by the operator of intelligent gaming table. For instance, one solution that has been employed in the gaming industry to prevent cheating and satisfy regulatory requirements has been to manufacture an intelligent gaming table that can use a proprietary processor running instructions to generate the game play activities from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game play activities, such as adding a new device driver used by the master table controller to operate a device during generation of the game play activities can require a new EPROM to be burnt, approved by the gaming jurisdiction and reinstalled on the intelligent gaming table in the presence of a gaming regulator. Regardless of whether the EPROM solution is used, to gain approval in most gaming jurisdictions, an intelligent gaming table must demonstrate sufficient safeguards that prevent an operator or player of an intelligent gaming table from manipulating hardware and software in a manner that gives them an unfair and some cases an illegal advantage. The intelligent gaming table should have a means to determine if the code it will execute is valid. If the code is not valid, the intelligent gaming table must have a means to prevent the code from being executed. The code validation requirements in the gaming industry affect both hardware and software designs on intelligent gaming tables.

A third important difference between intelligent gaming tables and common PC based computer systems is the number and kinds of peripheral devices used on an intelligent gaming table are not as great as on PC based computer systems. Traditionally, in the gaming industry, intelligent gaming tables have been relatively simple in the sense that the number of peripheral devices and the number of functions the intelligent gaming table has been limited. Further, in operation, the functionality of intelligent gaming tables were relatively constant once the intelligent gaming table was deployed, i.e., new peripherals devices and new gaming software were infrequently added to the intelligent gaming table. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on an intelligent gaming table, intelligent gaming tables still have unique device requirements that differ from a PC, such as device security requirements not usually addressed by PCs. For instance, monetary devices, such as coin dispensers, bill validators and ticket printers and computing devices that are used to govern the input and output of cash to an intelligent gaming table have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in intelligent gaming tables that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer may be used in International Game Technology (IGT) intelligent gaming tables to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Examples of specific configurations of software and apparatus on the gaming table that might be used in the practice of the present technology includes, by way of a non-limiting description:

An intelligent gaming table or electronic gaming table or hybrid electronic gaming table (with at least one physical random event generator such as dice, roulette wheel, candy wheel or big 6 wheel, or physical playing cards) having multiple player positions and individual player input positions comprising:

a) a gaming table surface;

b) individual player input positions on or in the gaming table surface, each player input position comprising an individual player display screen area (the table top may be a single screen, tiled screens or separate screens) and individual player input controls. The individual player controls may be buttons, touchscreen, mouse, voice control, retinal controls, or other forms of entering simple selection information;

c) a game processor executing code to perform a wagering game at the electronic gaming table; The game processor may be in communication with the physical random event generator in a hybrid system (with RFID reading of results, visual reading of results, electronic reading of the results, etc.) and is in communication link with the individual player position input controls, and with a random event (rand outcome) generator in the system.

d) a random event generator that provides a random event outcome for the wagering game and which provides information used by the processor to determine wagering game outcomes at each individual player input position where a wager has been placed in the wagering game; As noted, this random event generator may be a random number generator in the processor or a sensing system that recognizes outcomes in a physically generated outcome system and transmits the random outcome information to the processor.

e) each individual player input position having a control that provides information to the processor of an individual player position selection of one of a multiple number of available paytable and related volatility levels on which player position wagers at that individual player input position are made for a single wagering game;

f) the processor configured to resolve player position wagers at each individual player input position based upon the selected paytable for each individual player input position based on a single random event outcome for the wagering game.

The intelligent gaming table may provide at least two or at least three distinct paytable and related volatility levels to be available for selection at each player position, or a pseudo continuous scale of paytables may be selectable. By "pseudo continuous" it is meant that as wagers and probabilities are digitized (1X, 2X, 3X, 5X, 10X etc.), the slide cannot easily progress between 1X and 2X in indeterminate quanta intervals of 0.1, 0.001, 0.0001 etc. and there must be a finite and real gap between available paytable changes as reflected by wagers. These might include intervals of 0.1, 0.2, 0.5 etc., with residues lost or stored in memory and accounted for in the wagering system.

The intelligent gaming table may provide a specific wagering input control at each individual player position that enables selection of only a single paytable and related volatility level on a wager for the wagering game. The wagering input may have a series of buttons or virtual buttons on a touchscreen, with each button or each virtual button indicating a specific paytable and related volatility level to be used for determination of a wager placed at that individual player input control or a sliding control or virtual sliding control on a touchscreen, with each sliding control or each virtual sliding control indicating a general paytable and related volatility level to be used for determination of a wager placed at that individual player input control.

Reference to the figures will assist in an understanding and appreciation of the present technology.

FIG. 1 (Prior Art) shows certain embodiments may function in conjunction with a player monitoring system, such as the prior art player monitoring system 1 implemented on a poker table 10 as described in U.S. Pat. No. 6,672,589. This prior art system 1 being configured for tracking play of players at the gaming table 10, as well as providing information pertaining to the players, and includes a card reader 12 located adjacent a dealer position 13. The card reader 12 is coupled to a central computer 14 via a communication channel 15. The central computer 14 keeps track of the various players' accounts. Each player's account may include player information, such as, for example, the player's account number. System 1 includes a display monitor 20 that displays a representation of the blackjack table 10, including all player positions 11 (11*a*-11*g*) while a game is being played. In operation, when a player sits down at the table, the player presents his or her player card to the dealer, who then enters or "swipes" the card into the card reader 12. After a card is read by the card reader 12, the dealer touches the respective player position on the display monitor 20 where the player whose card has just been read is seated, thus associating the table position of the new player with the new player.

Figure 2:
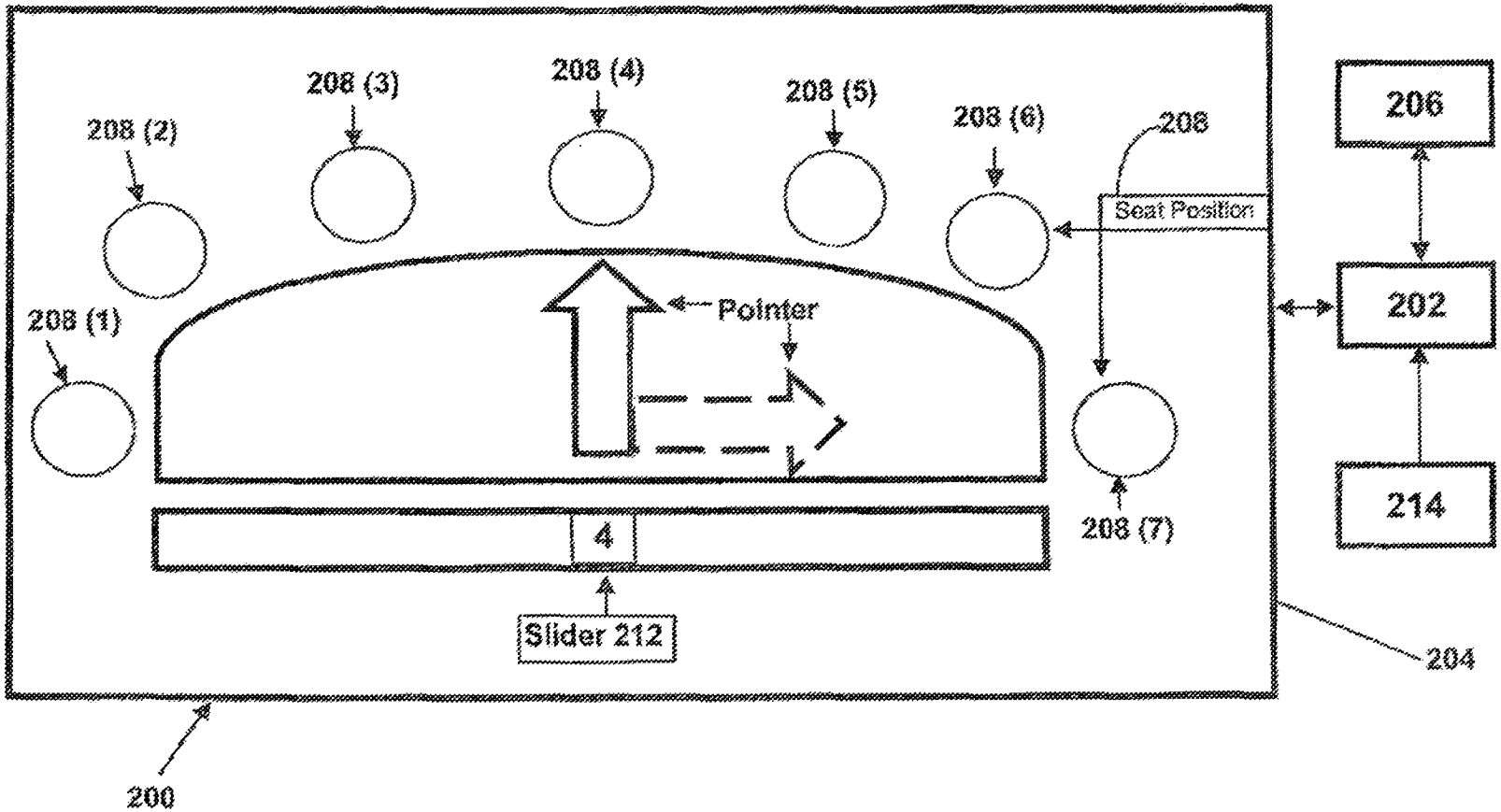
FIG. 2 shows a data input device as a touch-screen based icon or display figure that is movable to alter paytables and volatility.

Alternatively or in addition, certain embodiments operate in conjunction with a player monitoring system, such as the system show in FIG. 2. FIG. 2 is a schematic diagram depicting a top view of a gaming table system 200 according to an embodiment of the present disclosure. As illustrated in FIG. 2, the gaming table system 200 may be used for any table game including any card game, including poker and variants of poker, such as draw poker or stud poker against paytables. The table as shown includes seven player position input screens 208(1)-208(7). Alternative embodiments may provide for tables with any number of seating positions, or systems cable of tracking player activity at multiple tables. Each player position screen 208 will have individual player controls (not shown) such as the paytable and related volatility slide (not shown).

System 200 can include or be linked to a processor 202 that is linked by appropriate communication link to a display 204. System 200 can also be operatively linked to a data structure 206, database, or other suitable computing or storage functionality (e.g., a slot accounting system, or "SAS" computer). The data structure 206 may be used to store player account information. System 200 may include an account access device 214.

Account access device 214 may be used to access information related to a player's account. For example, the account access device 214 may be a card reader, wherein a player's identification card is inserted into the card reader. The card reader and/or a processor may determine a player's account number and provide it to the system 200. The account access device 214 may also be used to authenticate a player's identity. Other embodiments may include an account access device 214 that utilizes a keypad, or a biometric identification device such as a fingerprint scanner. The player's identification information may be provided to the processor 202. Access device 214 may be configured to accept an ID card input, e.g., as a card reader configured to read stored information on an ID card when a dealer "swipes" a player's ID card. A suitable card reader may be any type that is capable of reading or obtaining information from cards issued by the casino, such as, for example, a magnetic reader for reading magnetic stripes on cards, an electronic card reader for reading electronic cards, an RFID card reader, "smart card" reader and a data input device such as a keypad, touch screen or the like. While system 200 is described in relation to a typical poker table, one of skill in the art will appreciate that system 200 may be used in other gaming table applications, e.g., for draw poker, craps, roulette, etc.

Display 204 can any device enabled to display graphics supplied by a processor. For example, a computer monitor such as a CRT, plasma, LCD or other electronic display device. Display 204 can include a pointer 210 indicating a player location, e.g., 208(4) and a portion configured as data input device 212. The data input device 212 portion of display 204 may be enabled to accept input from a user and provide the input to other components of the system 200. The data input device 212 may be operative in tandem with pointer 210 to input a location on the display 204 that corresponds to a physical player position at the table. This pointer may be used where multiple players select different paytable and related volatility results, and the pointer can identify unique player positions and/or similar paytable and related volatility selections when same selections are made. In an example embodiment, the data input device 212 may be a touch-screen based icon or display figure that is movable as shown in FIG. 2. More specifically, a user may touch the portion of display 204 identified as data input device 212 to provide input. A user may drag or slide their fingers along the data input device 212 in order to move the pointer 210, or equivalently a similar slider at each player position input device 208 may adjust paytable and related volatility. Alternatively, the data input device 212 may take the form of touch sensitive keys or icons.

In operation of system 200, when a player having an identification/information (ID) card sits down or gains access to a particular gaming table, the table dealer can log the player into system 200. Using the slider 212 the dealer may locate the seat position of the player by touching the slider 212 in a corresponding position. For this purpose the slider 212 may include along its length number icons corresponding to player positions, e.g., numbers 1-7 spaced along the length of the slider 212. When a position is touched on the slider 212 the pointer 210 pivots to point toward the corresponding player position input devices 208(1)-(7) which may also be highlighted, change color or brightness to indicate the correspondence. After position the player, the player's ID card data can be entered (e.g., read into, or swiped) at access device 214, which can include a suitable card reader. Alternative embodiments may provide for other identification techniques, such as the use of biometric scanners or keypads.

In an additional embodiment, the pointer 210 may be dispensed with and the slider 212 may be directly used to highlight and designate player position input devices 208 (1)-208(7). Further, other embodiments of the system 200 may provide for multiple betting positions corresponding to a single seating position. For example, a single player at a blackjack table may play 2 or more hands simultaneously. The system 200 provides for tracking information of multiple hands related to a single player.

Figure 3:
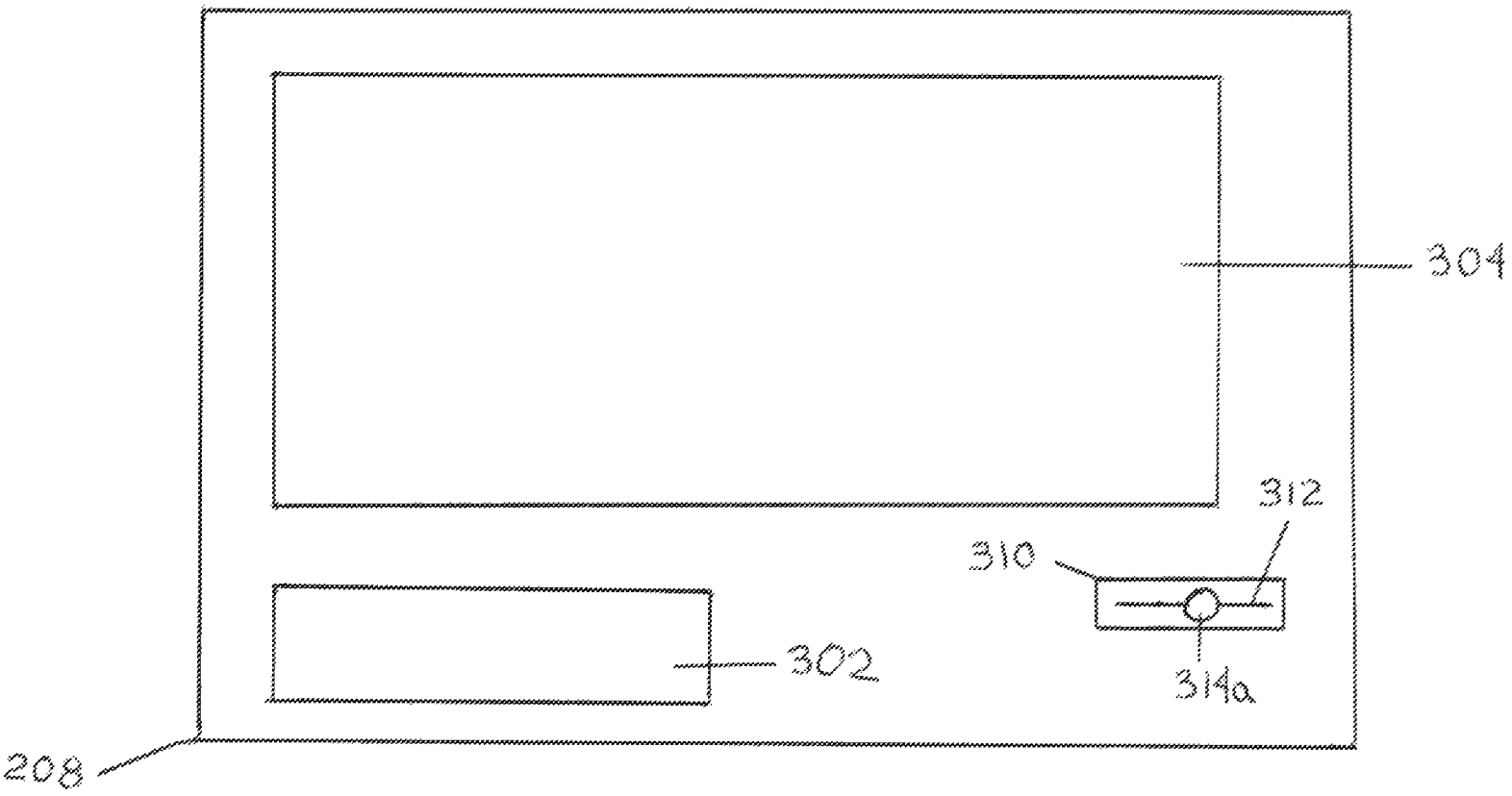
FIG. 3 shows a single player position input panel having a first player input panel which may be a touchscreen or button array.

FIG. 3 shows a single player position input panel 208, having a first player input panel 302 which may be a touchscreen or button array. A game event and game status display panel 304 is shown within a support frame 306. The paytable and related volatility slide component 310 is shown with a guidepath or slot 312 and a finger movement or position post 314*a*. The paytable and related volatility slide component 310 may be a virtual slide (e.g., on a touchscreen), or the entire field of slide component 310, slot 312, finger post 314, first player input panel 302 and game status panel 304 may be on a single touchscreen defining the entire area within the support frame 306.

Figure 4:
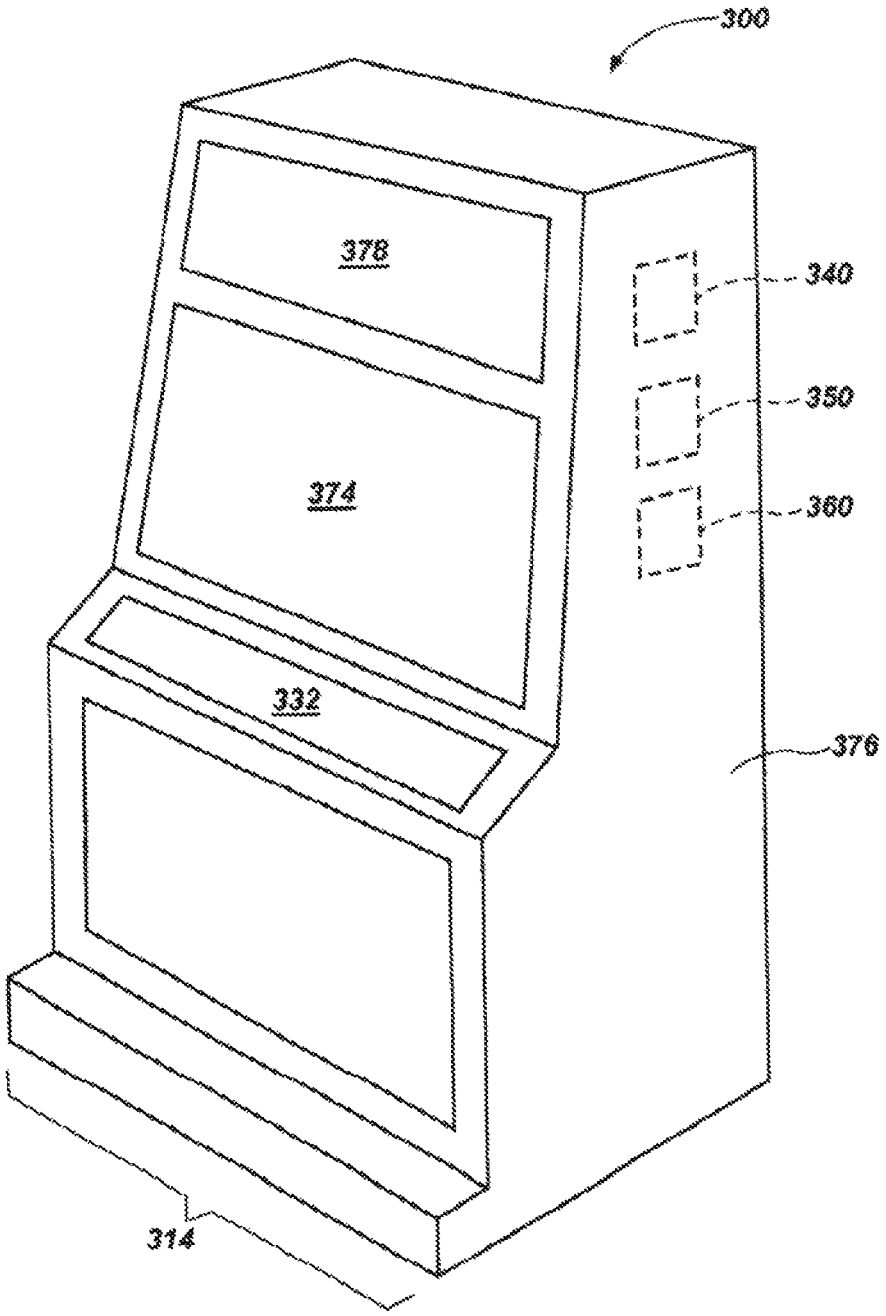
FIG. 4 is a rendition of an individual electronic gaming device configured for implementation of embodiments of wagering games according to the present disclosure.

FIG. 4 is a rendition of an individual electronic gaming device 300 configured for implementation of embodiments of wagering games according to the present disclosure.

Referring to FIG. 4, illustrated is an example of an individual electronic gaming device 300 (e.g., an electronic gaming machine (hereinafter, an "EGM") configured for implementation of embodiments of wagering games according to the present disclosure. The individual electronic gaming device 300 may include an individual player position 314 that includes a player input area 332 configured to enable a player to interact with the individual electronic gaming device 300 through various input devices. The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving a physical wheel, a physical ball or live personnel. The action may instead be simulated by a control processor 350 operably coupled to the memory 340 and interacting with and controlling the individual electronic gaming device 300. The EGM may also function as a player terminal to participate in a multi-player game administered by a dealer, the system having a community game outcome determining device, such as a reel slot machine or other electronic gaming machine wagering event wheel. The system may have a community display for displaying game outcomes (not shown). An example of a suitable multi-player system is disclosed in U.S. Pat. No. 6,659,866.

Although the figure has an outline of a traditional gaming cabinet, the individual electronic gaming device 300 may be implemented in any number of ways, including, but not limited to, client software downloaded to a portable device, such as a smart phone, tablet, or laptop personal computer. The individual electronic gaming device 300 may also be a non-portable personal computer (e.g., a desktop or all-in-one computer) or other computing device. In some embodiments, client software is not downloaded but is native to the device or is otherwise delivered with the device when distributed to a player.

A communication device 360 may be included and operably coupled to the processor such that information related to operation of the individual gaming device 300, information related to the game play, or combinations thereof may be communicated between the individual gaming device 300 and other devices (not shown) through a suitable communication media, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown), and speakers (not shown) for transmitting and/or receiving sounds during game play. Further detail of an example of an individual electronic gaming device 300 (as well as other embodiments of tables and devices) is disclosed in U.S. patent application Ser. No. 13/215,156, filed Aug. 22, 2011, published as U.S. Patent Publication No. 2013/0053117 on Feb. 28, 2013, and titled "METHODS OF MANAGING PLAY OF WAGERING GAMES AND SYSTEMS FOR MANAGING PLAY OF WAGERING GAMES," the disclosure of which is incorporated herein in its entirety by this reference.

Some embodiments may be implemented at locations that include a plurality of player stations. Such player stations may include an electronic display screen for display of game information, such as displaying a virtual roulette wheel, virtual chips, credit meters, win amounts, wagers made and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual roulette wheel, virtual chips, etc.), some features may remain in the physical domain. As such, the game play may be administered by a live dealer, a virtual dealer, or a combination of both.

Figure 5:
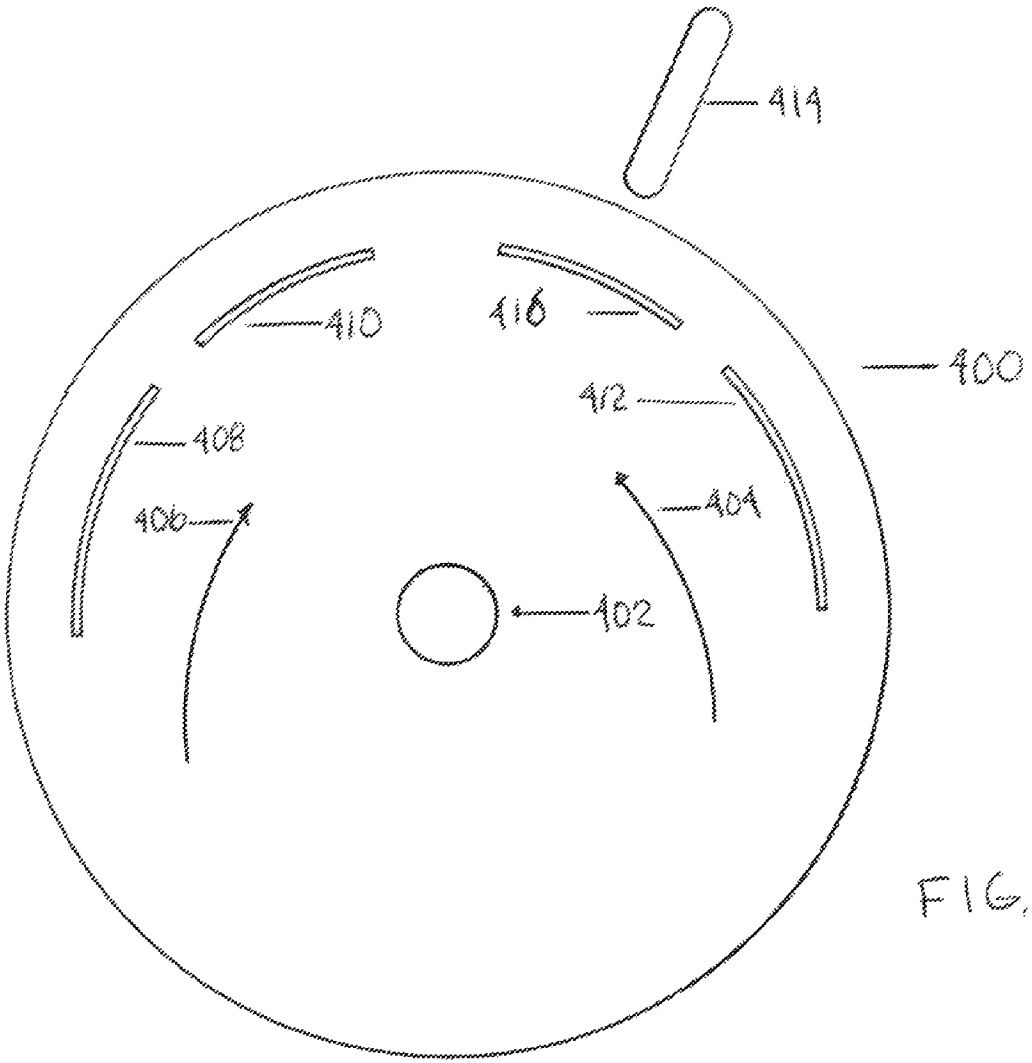
FIG. 5 is a rendition of a player-controlled rotating volatility control dial.

FIG. 5 is a rendition of a player-controlled rotating volatility control dial 400. The dial 400 is shown with four distinct regions 408, 410, 412 and 416 each of which may be separately aligned with a volatility setter 414. Each of the four distinct regions 408, 410, 412 and 416 may further have a range of variability within them. For example, with the setter 414 aligned with the third volatility range selection 416, the dial 400 may be further adjusted by gripping or virtually gripping dial control 402 to rotate the range selection 416 with respect to the setter 414 to increase the volatility by rotation direction 404 or lower the volatility within the range selection 416 by rotation in direction 406.

Figure 6:
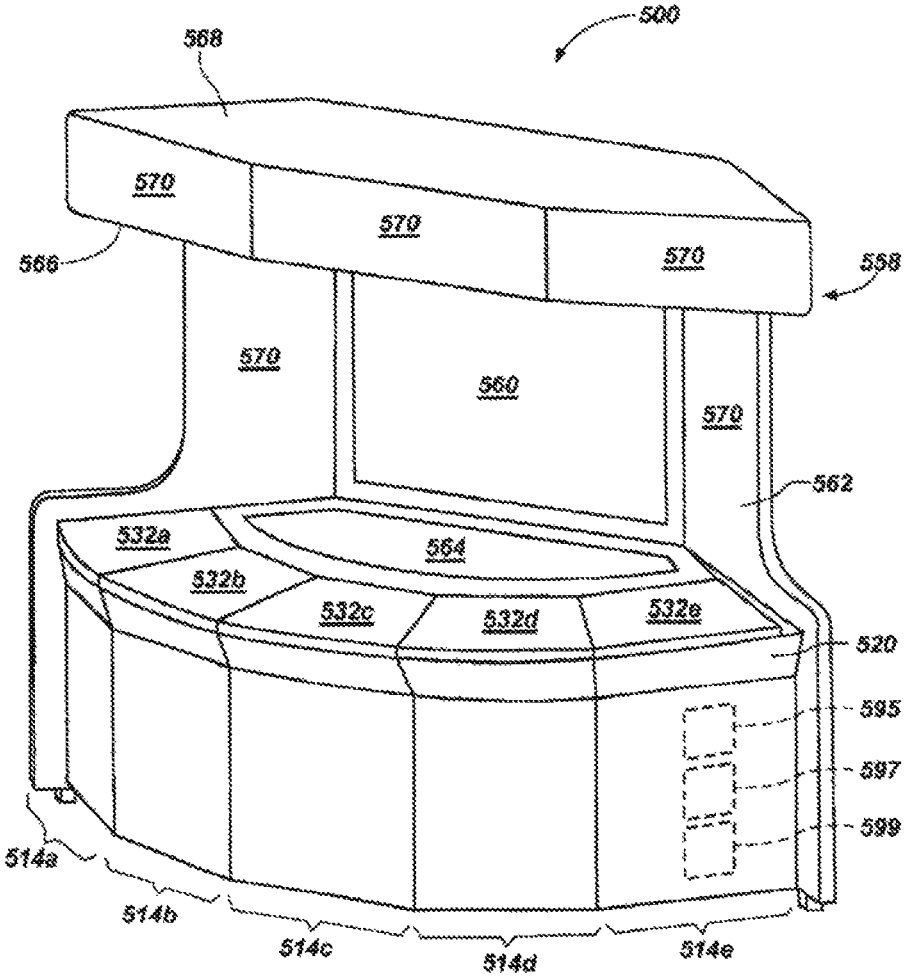
FIG. 6 is an example of a multiple-player, electronic table configured for implementation having a virtual dealer according to the present disclosure is shown.

FIG. 6 is an example of a multiple-player, electronic table configured for implementation having a virtual dealer according to the present disclosure is shown.

Figure 7:
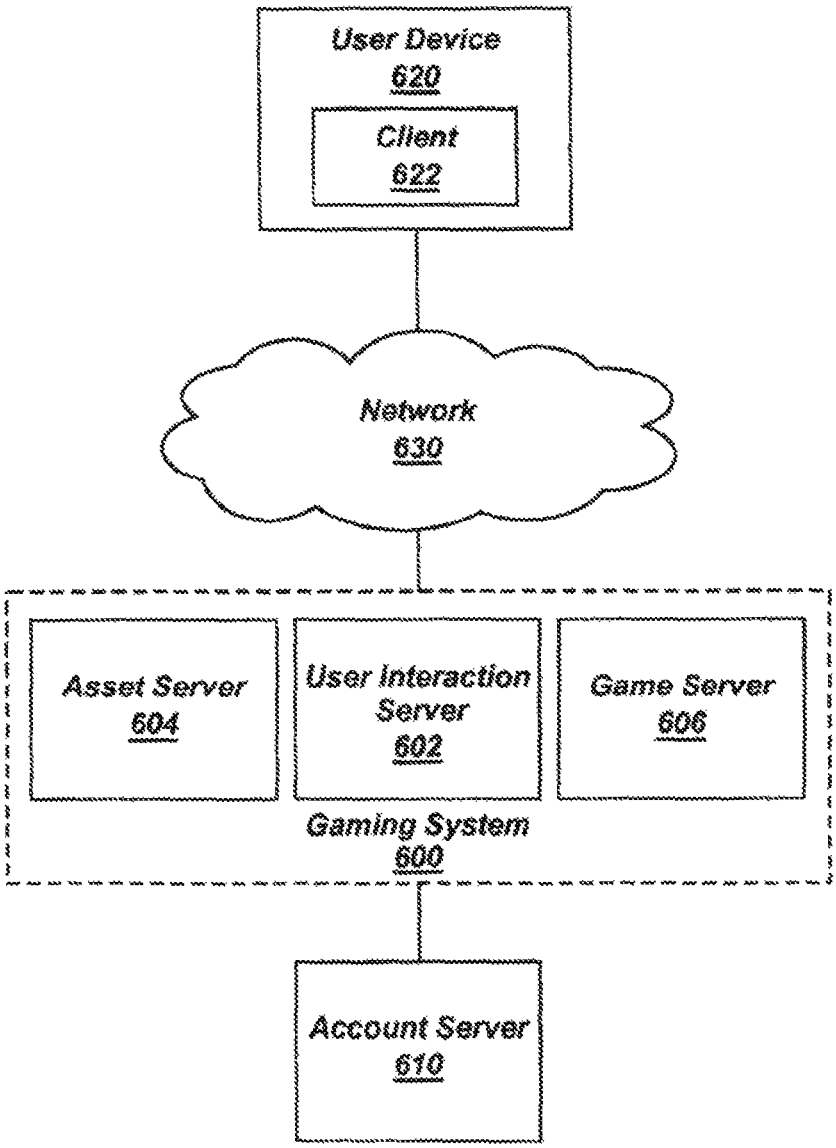
FIG. 7 is a schematic block diagram of a gaming system for implementing embodiments of waging games in accordance with the present disclosure.

Wagering games in accordance with embodiments of the disclosure may be administered over the Internet, or otherwise online, in one embodiment using a gaming system employing a client server architecture. Referring to FIG. 7, illustrated is a schematic block diagram of a gaming system 600 for implementing wagering games according to an embodiment of the present disclosure. The gaming system 600 enables end users to access proprietary and/or non-proprietary game content through an online casino client 622 ("the client 622"). Such game content may include, without limitation, various types of wagering games such as card games, dice games, big wheel games, roulette, scratch off games ("scratchers"), and any other wagering game where the game outcome is determined, in whole or in part, by one or more random events.

The client 622 may be an online casino that handles user funds, and enables play of a wide variety of casino-style games, such as roulette, card games, dice games, slot games, and EGM games. A player accesses the client 622 with a user device 620 such as a personal computer, tablet, cell phone or other mobile device over a network, such as the internet or a closed casino network. Players are able to make real money wagers through the user device 620 and the client 622 delivers game results to the player over a network (not shown). Losses are taken by the online casino, and wins are paid out to the player. The client 622 handles client funds, and interacts with financial service providers to transfer funds in and out of the casino accounts. The server architecture of the client 622 can take many forms. In one example, the client 622 is operably connected to a separate remote gaming system 600 that administers and delivers game results for one or more games, but in other embodiments, all of the online game play is administered in the client 622. Exemplary gaming systems 600 deliver game results, administer game rules, and confirm wagers are made and that funds are available, but such systems do not interact directly with users and do not handle player funds.

The wagering games supported by the gaming system 600 may track player account balances and may use this information to confirm a game result can be delivered. The same system could be used to administer play-for-fun games in which account balances are tracked but do not represent real currency.

The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access via a user device 620 to a wagering game hosted by a game server 606 through a user interaction server 602. The user device 620 may communicate with a user interaction server 602 of the gaming system 600 using a network 630 (e.g., the Internet). The user interaction server 602 may communicate with the game server 606 and provide game information, such as graphical displays and game interactions to the user. In some embodiments, the functionality of the gaming system may be incorporated into the online casino client 622. In some embodiments, a single user device 620 communicates with a game provided by the game server 606, while other embodiments may include a plurality of user devices 620 configured to communicate and provide end users with access to the same game provided by the game server 606. In addition, a plurality of end users may be permitted to access a single user interaction server 602, or a plurality of user interaction servers 602, to access the game server 606.

The user interaction server 602 may communicate with the user device 620 through the client 622 to enable access to the gaming system 600. The user may be unaware that the game is being administered by gaming system 600 and not the client 622. In embodiments, the user device 620 includes a user display that includes game assets delivered from the asset server 604 from gaming system 600, as well as casino assets (such as the casino name, logo and other distinctive graphics) delivered by the client 622. The user interaction server 602 may enable a user to create and access a user account and interact with gaming server 606. The user interaction server 602 may enable users to initiate new games, join existing games, and interface with games being played by the user.

In some embodiments, the user interaction server 602 may also provide the client 622 for execution on the user device 620 for accessing the gaming system 600. The client 622 provided by the gaming system 600 for execution on the user device 620 can comprise a variety of implementations according to the user device 620 and method of communication with the gaming system 600. In one embodiment, the user device 620 connects to the gaming system 600 using a web browser, and the client 622 executes within a browser window or frame of the web browser. In another embodiment, the client 622 is a stand-alone executable on the user device 620.

In one embodiment, the client 622 may comprise a relatively small amount of script (e.g., JAVASCRIPT®), also referred to as a "script driver," including scripting language that controls an interface of the client 622. The script driver may include simple function calls requesting information from the gaming system 600. In other words, the script driver stored in the client 622 may merely include calls to functions that are externally defined by, and executed by, the gaming system 600. As a result, the client 622 may be characterized as a "thin client." As that term is used herein, the client 622 may be little more than a script player. The client 622 may simply send requests to the gaming system 600 rather than performing logic itself for the games administered by gaming system 600. The client 622 may perform logic for other games that are not administered by gaming system 600. For example, gaming system 600 may administer an online casino's card games while all other games are administered by the client 622. The client 622 receives player inputs, and the player inputs are passed to the gaming system 600 for processing and executing the wagering game. In one embodiment, this includes providing specific graphical display information to the client 622 as well as game outcomes.

In other embodiments, the client 622 comprises an executable file rather than a script. In that case, the client 622 may do more local processing than does a script driver, such as calculating where to show what game symbols upon receiving a game outcome from game server 606 through user interaction server 602. In one embodiment, it may be that portions of an asset server 604 are loaded onto the client 622 and are used by the client 622 in processing and updating graphical displays. Due to security and integrity concerns, most embodiments will have the bulk of the processing of the game play performed in the gaming system 600. However, some embodiments may include significant game processing by the client 622 when the client and user device 620 are considered trustworthy or when there is reduced concern for security and integrity in the displayed game outcome. In most embodiments, it is expected that some form of data protection, such as end-to-end encryption, will be used when data is transported over network 630. Network 630 may be any network, including, but not limited to, the Internet.

In an embodiment where the client 622 implements further logic and game control methodology beyond the thin client, the client 622 may parse and define player interactions prior to passing the player interactions to the gaming system 600. Likewise, when the client 622 receives a gaming interaction from the gaming system 600, the client 622 may be configured to determine how to modify the display as a result of the gaming interaction. The client 622 may also allow the player to change a perspective or otherwise interact with elements of the display that do not change aspects of the game.

The gaming system 600 may include an asset server 604, which may host various media assets (e.g., audio, video, and image files) that may be sent to the client 622 for presenting the various wagering games to the end user. In other words, in this embodiment, the assets presented to the end user may be stored separately from the client 622. In one embodiment, the client 622 requests the assets appropriate for the game played by the user; in other embodiments, especially those using thin clients, just those assets that are needed for a particular display event will be sent by game server 606 when the game server 606 determines they are needed, including as few as one asset. In one example, the client 622 may call a function defined at the user interaction server 602 or asset server 604, which may determine which assets are to be delivered to the client 622 as well as how the assets are to be presented by the client 622 to the end user. Different assets may correspond to the various clients that may have access to the game server 606 or to different games to be played.

The game server 606 is configured to perform game play methods and determine game play outcomes that are provided to the user interaction server 602 to be transmitted to the user device 620 for display on the end user's computer. For example, the game server 606 may include game rules for one or more wagering games, such that the game server 606 controls some or all of the game flow for a selected wagering game as well as the determined game outcomes. The game server 606 may include pay tables and other game logic. The game server 606 also performs random number generation for determining random game elements of the wagering game. In one embodiment, the game server 606 is separated from the user interaction server 602 by a firewall or other method of preventing unauthorized access to the game server 606 from the general members of the network 630.

The user device 620 may present a gaming interface to the player and communicate the user interaction to the gaming system 600. The user device 620 may be any electronic system capable of displaying gaming information, receiving user input, and communicating the user input to the gaming system 600. As such, the user device 620 can be a desktop computer, a laptop, a tablet computer, a set-top box, a mobile device (including, but not limited to, a smartphone), a kiosk, a terminal, or another computing device. The user device 620 operating the client 622 may comprise an interactive electronic gaming system 300 (see FIG. 4), as described above. The client 622 may be a specialized application or may be executed within a generalized application capable of interpreting instructions from an interactive gaming system, such as a web browser.

The client 622 may interface with an end user through a web page or an application that runs on a device including, but not limited to, a smartphone, a tablet, or a general computer, or the client 622 may be any other computer program configurable to access the gaming system 600. The client 622 may be illustrated within a casino webpage (or other interface) indicating that the client 622 is embedded into a webpage, which is supported by a web browser executing on the user device 620.

In one embodiment, the gaming system 600 may be operated by a different entity than the operator of the client 622. The hardware of gaming system 600 may be located remotely from the client 622. The user device 620 may be operated by a third party, such as a casino or an individual, that links to the gaming system 600, which may be operated, for example, by a wagering game service provider. Therefore, in some embodiments, the user device 620 and the client 622 may be operated by a different administrator than the operator of the game server 606, and the user device 620 and the client 622 may also be operated by separate administrators. In other words, the user device 620 may be part of a third-party system that does not administer or otherwise control the gaming system 600 or game server 606.

In another embodiment, the user interaction server 602 and asset server 604 are provided by a third-party system. For example, a gaming entity (e.g., a casino) may operate the user interaction server 602 or user device 620 to provide its customers access to game content managed by a different entity that may control game server 606, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming system 600 may communicate with one or more external account servers 610, optionally through another firewall. For example, the gaming system 600 itself may not directly accept wagers or issue payouts. That is, the gaming system 600 may facilitate online casino gaming but may not be part of a self-contained online casino itself. Instead, the gaming system 600 may facilitate the play of wagering games owned and controlled by a company offering games and gaming products and services, such as SHFL entertainment, Inc. Another entity (e.g., a casino or any account holder or financial system of record) may operate and maintain its external account servers 610 to accept bets and make payout distributions. The gaming system 600 may communicate with the account servers 610 to verify the existence of funds for wagering and to instruct the account server 610 to execute debits and credits.

In some embodiments, the gaming system 600 may directly accept bets and make payout distributions, such as in the case where an administrator of the gaming system 600 operates as the client 622. As discussed above, the gaming system 600 may be integrated within the operations of a casino rather than separating out functionality (e.g., game content, game play, credits, debits, etc.) among different entities. In addition, for play-for-fun wagering games, the gaming system 600 may issue credits, take bets, and manage the balance of the credits according to the game outcomes, but the gaming system 600 may not permit payout distributions or be linked to an account server 610 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling. In embodiments where a user device 620 accesses games administered by gaming system 600 through the client 622, the account server 610 contains "minor accounts" that track account balances to confirm wagers have been made and there are funds to support the wagers before delivering game results. In this embodiment, no actual player funds are handled by the account server 610.

The gaming system 600 may be configured in many ways, from a fully integrated single system to a distributed server architecture. The asset server 604, the user interaction server 602, the game server 606, and the account server 610 may be configured as a single, integrated system of code modules running on a single server or machine, where each of the servers is functionally implemented on a single machine. In such a case, the functionality described herein may not be implemented as separate code modules. The asset server 604, the user interaction server 602, the game server 606, and the account server 610 may also be implemented as a plurality of independent servers, each using its own code modules running on a separate physical machine, and may further include one or more firewalls between selected servers (depending on security needs). Each server could communicate over some kind of networked connection, potentially as varied as that described for network 630. Further, each single server shown in FIG. 7 may be implemented as a plurality of servers with load balancing and scalability factors built into the embodiment. All such embodiments and variations are fully contemplated.

Additional features may be supported by the game server 606, such as hacking and cheating detection, data storage and archival, metrics generation, messages generation, output formatting for different end user devices, as well as other features and operations. For example, the gaming system 600 may include additional features and configurations as described in U.S. patent application Ser. No. 13/353,194, filed Jan. 18, 2012, and application Ser. No. 13/609,031, filed Sep. 10, 2012, both titled "NETWORK GAMING ARCHITECTURE, GAMING SYSTEMS, AND RELATED METHODS," the disclosures of which are incorporated herein in their entirety by this reference.

The network 630 may enable communications between the user device 620 and the gaming system 600, and the user device 620 and the online casino client 622. A network may also connect the gaming system 600 and account server 610, and, further, one or more networks may interconnect one or more of the other servers shown collectively as the game system 600. In one embodiment, the network 630 uses standard communications technologies and/or protocols. Thus, the network 630 can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 630 can include links comprising one or more networks such as the Internet.

Figure 8:
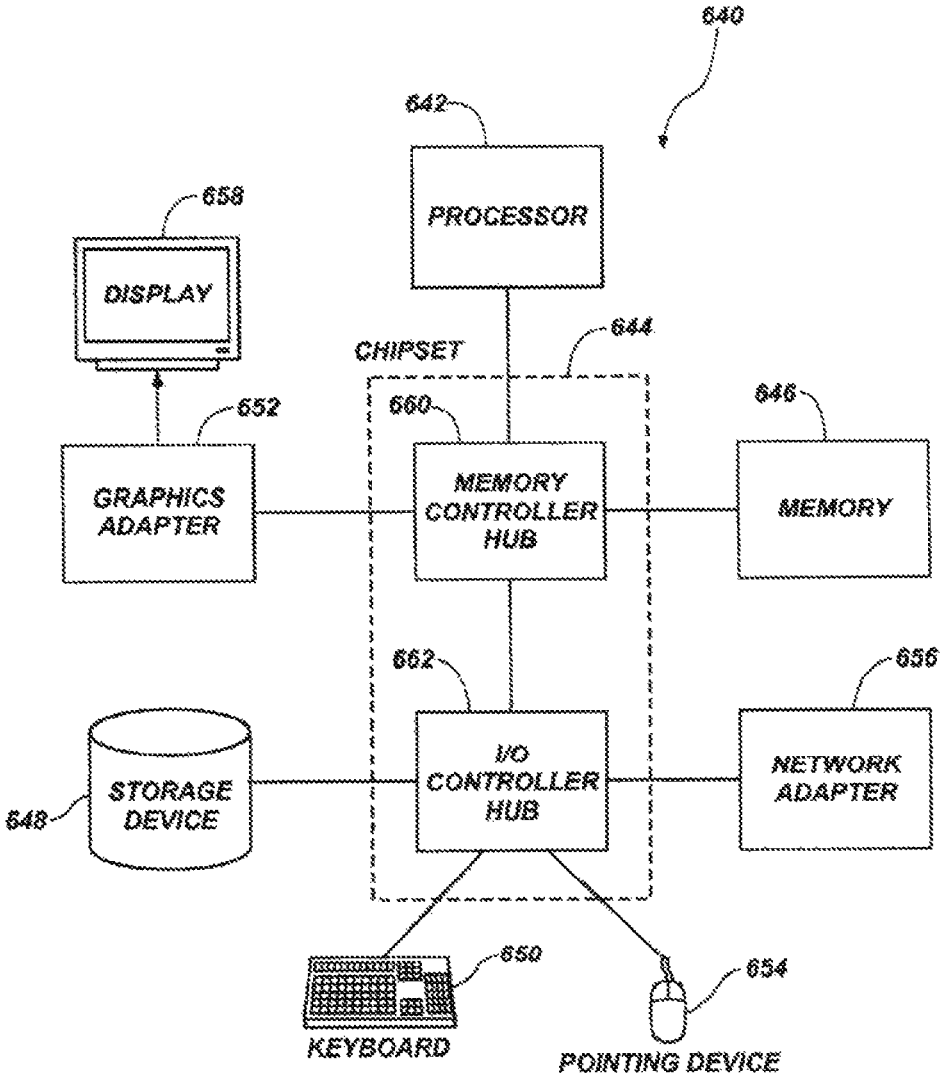
FIG. 8 is a block diagram of a computer for acting as a gaming system for implementing embodiments of wagering games in accordance with the present disclosure

Referring to FIG. 8, a high-level block diagram of a computer system 640 for acting as the gaming system 600 (see FIG. 7) according to one embodiment is shown. Illustrated are at least one processor 642 coupled to a chipset 644, as indicated in dashed lines. Also coupled to the chipset 644 are memory 646, a storage device 648, a keyboard 650, a graphics adapter 652, a pointing device 654, and a network adapter 656. A display 658 is coupled to the graphics adapter 652. In one embodiment, the functionality of the chipset 644 is provided by a memory controller hub 660 and an I/O controller hub 662. In another embodiment, the memory 646 is coupled directly to the processor 642 instead of to the chipset 644.

The storage device 648 is any non-transitory computer-readable storage medium, such as a hard drive, a compact disc read-only memory (CD-ROM), a DVD, or a solid-state memory device (e.g., a flash drive). The memory 646 holds instructions and data used by the processor 642. The pointing device 654 may be a mouse, a track pad, a track ball, or another type of pointing device, and it is used in combination with the keyboard 650 to input data into the computer system 640.

The graphics adapter 652 displays images and other information on the display 658. The network adapter 656 couples the computer system 640 to a local or wide area network.

As is known in the art, the computer system 640 can have different and/or other components than those shown in FIG. 8. In addition, the computer system 640 can lack certain illustrated components. In one embodiment, the computer system 640 acting as the gaming system 600 (FIG. 7) lacks the keyboard 650, pointing device 654, graphics adapter 652, and/or display 658. Moreover, the storage device 648 can be local and/or remote from the computer system 640 (such as embodied within a storage area network (SAN)). Moreover, other input devices, such as, for example, touch screens may be included.

The network adapter 656 (may also be referred to herein as a communication device) may include one or more devices for communicating using one or more of the communication media and protocols discussed above with respect to FIG. 7.

In addition, some or all of the components of this general computer system 640 of FIG. 8 may be used as part of the processor and memory discussed above with respect to the systems of FIGS. 4, 5, and 6.

The gaming system 600 (FIG. 7) may comprise several such computer systems 640. The gaming system 600 may include load balancers, firewalls, and various other components for assisting the gaming system 600 to provide services to a variety of user devices.

As is known in the art, the computer system 640 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 648, loaded into the memory 646, and executed by the processor 642.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product that can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

In some embodiments, wagering games may be administered over a network. For example, a method of administering a game of roulette over a network may involve receiving at a user interaction server authorization from a player to allocate funds to a wager. A multiplier may be randomly selected at a game server from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize payment of a payout to the player within the paytable of the selected range of volatility. An amount of the payout may be equal to an amount of the wager multiplied by the randomly selected multiplier. The game server may authorize collection of the amount of the wager for the house when the randomly generated number is different from the randomly generated number from the immediately preceding round.

As another specific, nonlimiting example, a method of administering a play-for-free underlying game over a network may include sending from a user interaction server or the client 622 a quantity of valueless wagering elements usable within a predetermined time period to a player. Authorization from a player may be received at the user interaction server or the client 622 to allocate at least one valueless wagering element to a wager. When a gaming system 600 is utilized by the client 622, a game server may randomly select a Range of volatility from a group of fixed or variable ranges for a payout on the wager. The game server may randomly generate a number and associated color within a range of numbers and associated colors. The wager may be resolved by determining at the beginning of any random outcome game server what will be therandomly generated range of volatility. The game server may authorize issuance of additional valueless wagering elements to the player when the randomly generated number is identical to the randomly generated number from the immediately preceding round. A quantity of the additional valueless wagering elements may be equal to the quantity of valueless wagering elements allocated to the wager multiplied by the randomly selected multiplier. Functions performed by the game server 606 may be performed by other components of the online gaming system 600 or the client 622 in other embodiments.

Although specific components, systems and games have been described, one skilled in the art will appreciate that options, alternatives and equivalents may be used.

What is claimed:

1. An intelligent electronic gaming table configured to facilitate play of a wagering game between a least one player and a dealer, the intelligent electronic gaming table comprising:

a) a gaming table surface;

b) at least one individual player input position on the gaming table surface, each player input position including:

i) an individual player display device;

ii) at least one individual player input control selected from the group consisting of a touch screen with a virtual slider, a physical slider, or a physical turning dial that is configured to generate a signal indicative of a selection of one of a plurality of different paytables for use in the wagering game for the respective individual player input position, wherein each of the plurality of different paytables are associated with a different volatility level selected from a plurality of volatility levels; and iii) at least one of a coin dispenser, bill validator and ticket printer for accepting or issuing credits; and c) a game processor configured to execute computer-readable instructions to facilitate the wagering game at the intelligent electronic gaming table including:

i) accepting a wager of an amount of credits at one or more of the individual player input positions;

ii) receiving the signal indicative of a selection of one of the plurality of different paytables from each of the one more the individual player input positions from which a wager was accepted;

iii) providing, via a random event generator, a random event or the wagering game;

iv) determining a player outcome for each of the individual player input positions from which a wager was accepted using the random event;

v) determining a single dealer outcome for the dealer using the random event; and vi) resolving any accepted wagers by comparing the associated player outcome with the single dealer outcome, for each accepted wager, based upon the selected paytable associated with each accepted wager and the volatility level of the selected paytable.

2. The intelligent electronic gaming table of claim 1, wherein the at least one individual player input position includes a plurality of individual player input positions for a plurality of players.

3. The intelligent electronic gaming table of claim 1, wherein the plurality of paytables includes at least two or three distinct paytables.

4. The intelligent electronic gaming table of claim 1, wherein the individual player input control at each individual player input position allows selection of only a single one of the plurality of different paytables for the wagering game.

5. The intelligent electronic gaming table of claim 1, further comprising:

the game processor configured to receive a signal indicative of at least one side bet wager from at least one of the at least one individual player input positions.

6. The intelligent electronic gaming table of claim 1, wherein the at least one side bet wager includes at least two side bet wagers.

7. The intelligent electronic gaming table of claim 1, wherein the wagering game is a poker game playable with physical or virtual playing cards.

8. The intelligent electronic gaming table of claim 7, wherein payout odds for a three-of-a-kind and a four-of-a-kind in the poker game differ between at least two of the plurality of different paytables.

9. The intelligent electronic gaming table of claim 1, wherein the display device of each respective individual player input position is configured to display the selected paytable.

10. The intelligent electronic gaming table of claim 1, wherein the physical slider or the physical turning dial includes at least one of a physical variable resistor or a rheostat that facilitates the selection of one of the plurality of different paytables.

11. A method of facilitating a wagering game between at least one player and a dealer on an intelligent electronic gaming table having a gaming table surface, at least one individual player position on the gaming table surface, each player input position including an individual player display device, at least one individual player input control selected from the group consisting of a touch screen with a virtual slider, a physical slider, or a physical turning dial that is configured to generate a signal indicative of a selection of one of a plurality of different paytables for use in the wagering game for the respective individual player input position, each of the plurality of different paytables being associated with a different volatility level selected from a plurality of volatility levels, and at least one of a coin dispenser, bill validator, and ticket dispenser for issuing credits, the method comprising:

a game processor executing computer-readable instructions to facilitate the wagering game at the intelligent electronic table including:

accepting a wager of an amount of credits at one or more of the individual player input positions;

receiving the signal indicative of a selection of one of the plurality of different paytables from each of the one or more of the multiple individual player input positions from which a wager was accepted;

providing, via a random event generator, a random event for the wagering game;

determining a player outcome for each of the multiple individual player input positions from which a wager was accepted using the random event;

determining a single dealer outcome for the dealer using the random event; and resolving any accepted wagers by comparing the associated player outcome with the single dealer outcome, for each accepted wager, based upon the selected paytable associated with each accepted wager and the volatility level of the selected paytable.

12. The method of claim 11, further comprising:

the game processor receiving a signal indicative of at least one side bet wager from at least one of the at least one individual player input positions.

13. The method of claim 12, wherein the at least one side bet wager includes at least two side bet wagers.

14. The method of claim 11, wherein the wagering game is a poker game playable with physical or virtual playing cards.

15. The method of claim 12, wherein payout odds for a three-of-a-kind and a four-of-a-kind in the poker game differ between at least two of the plurality of different paytables.

16. The method of claim 11, further comprising:

after receiving the signal indicative of the selection of one of the plurality of different paytables, the display device of the respective individual player input position displays the selected paytable.

17. The method of claim 11, wherein the physical slider or the physical turning dial includes at least one of a physical variable resistor or a rheostat that facilitates the selection of one of the plurality of different paytables.

18. The method of claim 11, wherein the at least one individual player input position includes a plurality of individual player input positions for a plurality of players.

19. The method of claim 11, wherein the plurality of paytables includes at least two or three distinct paytables.

20. The method of claim 11, wherein the individual player input control at each individual player input position allows selection of only a single one of the plurality of different paytables for the wagering game.

* * * * *